US005928116A

United States Patent [19]

Chiang

[11] Patent Number: 5,928,116

[45] Date of Patent: Jul. 27, 1999

[54] BODY EXERCISER

[76] Inventor: Yao-Chin Chiang, 122-2, Shoei Nan Road, Taichung, Taiwan

[21] Appl. No.: 09/009,005

[22] Filed: Jan. 20, 1998

[51] Int. Cl.[6] ..... A63B 22/00

[52] U.S. Cl. ..... 482/72; 482/95; 482/133; 482/142

[58] Field of Search ..... 482/51, 72, 73, 482/92, 93, 95, 96, 121–123, 131–137, 139, 142, 908; D21/686–690

[56] References Cited

U.S. PATENT DOCUMENTS

| | | | |
|---|---|---|---|
| 4,632,390 | 12/1986 | Richey | 482/96 |
| 5,163,890 | 11/1992 | Perry, Jr. | 482/142 |
| 5,478,296 | 12/1995 | Lee | 482/131 |
| 5,505,679 | 4/1996 | McBride et al. | 482/53 |
| 5,512,027 | 4/1996 | Chen | 482/95 |
| 5,529,557 | 6/1996 | Barton | 482/95 |
| 5,580,340 | 12/1996 | Yu | 482/96 |
| 5,665,041 | 9/1997 | Hsieh | 482/140 |
| 5,810,698 | 9/1998 | Hullett et al. | 482/96 |

FOREIGN PATENT DOCUMENTS

| | | | |
|---|---|---|---|
| 2133298 | 7/1984 | United Kingdom | 482/72 |

*Primary Examiner*—Jeanne M. Clark
*Attorney, Agent, or Firm*—David and Raymond; Raymond Y. Chan

[57] ABSTRACT

A body exerciser, which can perform boat rowing action exercise and bench pressing exercise, includes a pair of handles which are free to rotate from 0 to 360 degrees and rotatably connected at two corresponding sides of the base frame. When the handles are turning, a pair of draw bars which are connected to the handles would also be simultaneously displaced. Thus, the user sitting on a cushion would experience an up and down repeated motion. Furthermore, the moment of the force between the two draw bars and the handles can be adjusted according to the ability of the user, so that the user can get a complete workout from the body exerciser of the present invention.

5 Claims, 5 Drawing Sheets

172
24
181
25
21
22
12
19
18B
14B
16B
171
17
15
13
A
16A
201
23
231
181
19
20
21
22
18A
14A
10
12
11

171
17
15
16B
17
13
11
16A
171

BODY EXERCISER

FIELD OF THE PRESENT INVENTION

The present invention relates to a body exerciser, and more particularly to an exercising apparatus that can perform boat rowing action exercise and bench pressing exercise. The body exerciser mainly comprises a pair of handles which are free to rotate from 0 to 360 degrees and symmetrically provided at two corresponding sides of the base frame. When the handles are turning, a pair of draw bars which are connected to the handles would also be simultaneously displaced so as to drive a cushion and the user sitting thereon to have an up and down repeated motion. Furthermore, the moment of force between the draw bars and the handles can be adjusted according to the ability of the user, so that the user can get a complete workout from the body exerciser of the present invention.

BACKGROUND OF THE PRESENT INVENTION

Most people in United States care very much about the health of their bodies. That is why there are health clubs and fitness centers everywhere. At beginning of each year, many people make resolution to get a healthier body for that year by spending a lot of money to joint the health club or fitness center, but after money is paid out, most people just could not find the time for traveling to the health club or fitness center to do the exercise they planned to do.

Other people build their own gym in home or their garages by purchasing different types of exercising machines to work at different muscles. There are plenty of exercising machines on the market that can perform the boat rowing action exercise and the bench pressing exercise, such as the boat rowing exerciser or the multi-function exerciser that can train and target different muscle groups of the body.

However, the boat rowing exerciser mentioned above can only perform a single exercise, which is the boat rowing action exercise. The exercise is simply pulling the arms back and forth, and adds little action to the stomach area by bending back and forth. Because the bar rowing exerciser only targets with few muscles, the exercising result is thus very limited.

Although the multi-function exerciser of the conventional exercising machine is able to target variety of muscle groups and allows user to get a total workout, it still has its shortcomings as follows.

(1) The structure of the multi-function exercise are complex with different exercising equipment. It is heavy in weight that takes more than one person to move it around. It also takes up large storage space that even when the user is not exercising, the multi-function exerciser can not be folded or shrunk down to a smaller volume for easy storage, and thus those families without adequate space at home can not own one.

(2) The bench pressing exerciser provided on the multi-function exerciser is constructed simply by adding a bench weight set. This type of structure provides no additional advantage but only increases the production cost. It is, therefore, not economical.

(3) The user can not workout by himself or herself because to workout with free weight requires a partner to spot you in case you run out of the strength.

SUMMARY OF THE PRESENT INVENTION

It is thus a main object of the present invention to provide a body exerciser, which handles are free to rotate from 0 to 360 degrees and symmetrically at two corresponding sides of the base frame. When the handles are turning, a pair of draw bars which are connected to the handles would also be simultaneously displaced so as to drive a cushion and the user sitting thereon to have an up and down repeated motion. Furthermore, the moment of force between the draw bars and the handles can be adjusted according to the ability of the user, so that the user can get a complete workout from the body exerciser of the present invention.

A further object of the present invention is to provide a body exerciser, which can perform the boat rowing action exercise and the bench pressing exercise in one machine to work variety of muscle groups of the body.

Yet another object of the present invention is to provide a body exerciser, which does not occupy much space during operation or not in use, thus it is ideal for any families.

Still another object of the present invention is to provide a body exerciser, which makes the exercising fun with two different methods of exercise so that the user can workout their body targeting different muscle groups of the body.

Still another object of the present invention is to provide a body exerciser, which allows the users to workout with their own bodies so that they can workout whenever they want without worrying about the safety concern of the free weight workout machine.

In order to achieve the objects above, the present invention provides a body exerciser which comprises a H-shape base frame which has a central base stand, a pair of vertical guide stays upwardly and proximately extending from two ends of the central base stand, a U-shape central handle rest affixed at a center portion of the central base stand between the two vertical guide stays, a pair of rests respectively affixed on the central base stand near the two vertical guide stays, and a rotatable axle which is horizontally and rotatably passed through the central handle rest of a center portion of the central base stand. A pair of handle axles each has a first end, in which the two first ends of the two handle axles are pivotally connected to two outer ends of the rotatably axle respectively. A pair of L-shape handles are respectively extended upwardly from two second ends of the rotatably axle. By turning the two handles about the two handle axles, the rotatable axle is driven to freely rotate. A driving element has a central portion engaged by the rotatable axle. By rotating the rotatable axle clockwise and counterclockwise, the driving element is driven to rotate about the rotatable axle clockwise and counterclockwise simultaneously so as to drive two ends of the driving element moving up and down. A pair of draw bars each has a pivot end, the two pivot ends of the two draw bars pivotally connecting to the two ends of the driving element respectively for enabling to pivotally and mutually drive one another. A pair of adjustable links are pivotally connected with two connecting ends of the two draw bars respectively, wherein two bottom ends of the two adjustable links are pivotally connected with the two rests respectively. A pair of toggle links each has a first end pivotally connected to a top end of the corresponding adjustable link. A tubular supporting stand comprises a pair of hollow guiding tube integrally and downwardly extended from a bottom portion of the supporting stand for the two guide stays to respectively insert therein. A pair of bearers are integrally and horizontally extended from the two guiding tubes of the supporting stand toward the two rests respectively, wherein the two second ends of the two toggle links are pivotally connected with the two bearers respectively. A cushion is affixed on the tubular supporting stand. A seat cushion is slidably mounted on the supporting stand by a plurality of rollers provided under the seat cushion, the rollers allowing the seat cushion to forwardly and backwardly slide forth and back along the supporting stand. A pair of pedals are rotatably connected to one of the guiding tubes positioned near the seat cushion.

DETAILED DESCRIPTION OF THE PREFERRED EMBODIMENT

Figures 1, 2:
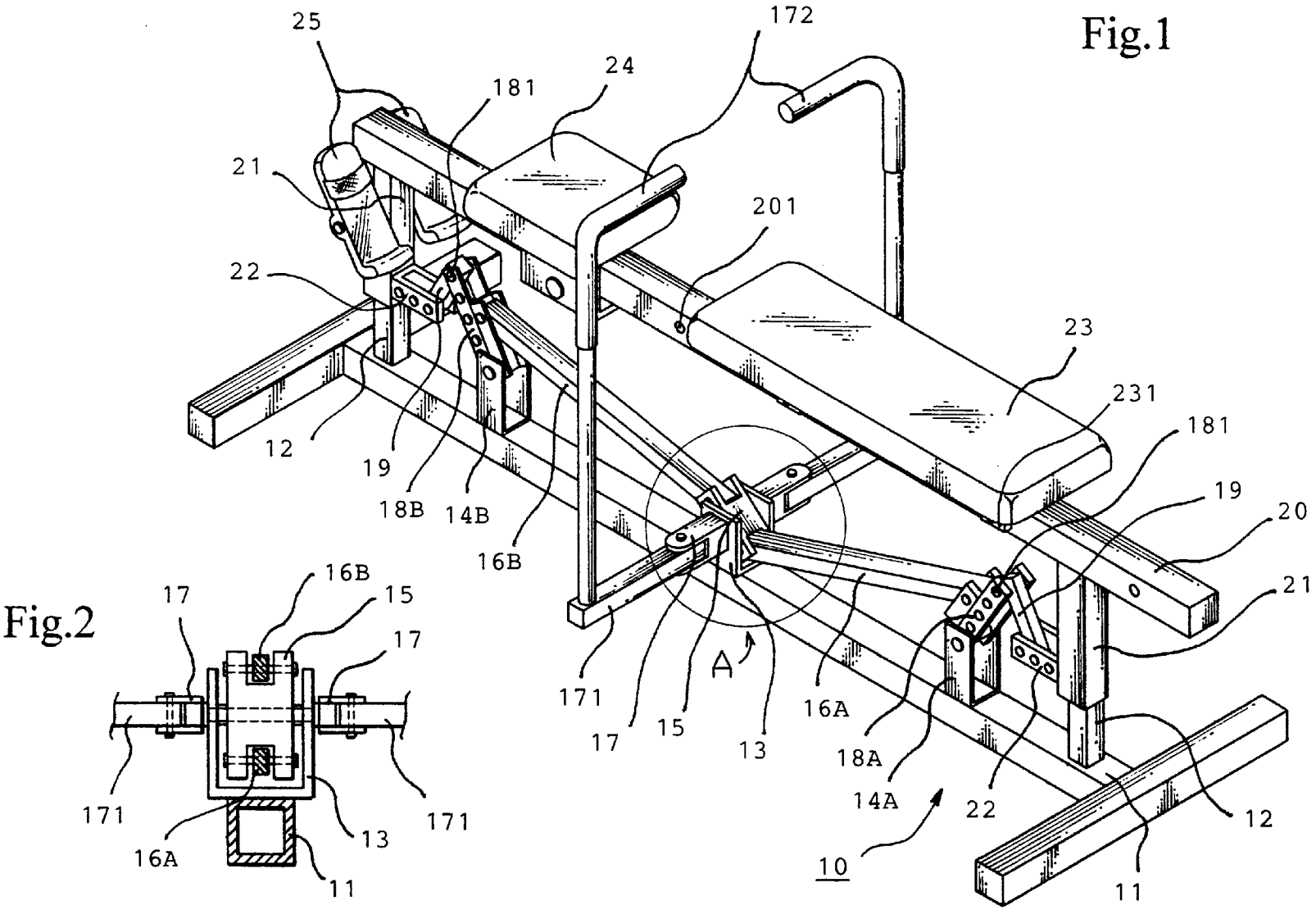
FIG. 1 is a perspective view of a body exerciser in accordance with a preferred embodiment of the present invention.
FIG. 2 is an enlarged sectional view of the encircled portion designated by A in FIG. 1 in accordance with the above preferred embodiment of the present invention.

Referring to FIGS. 1 to 4 of the drawings, a body exerciser according to a preferred embodiment of the present invention is illustrated. The body exerciser comprises a H-shape base frame 10 which has a central base stand 11, a pair of vertical guide stays 12A, 12B upwardly and proximately extending from two ends of the central base stand 11, a U-shape central handle rest 13 affixed at a center portion of the central base stand 11 between the two vertical guide stays 12A, 12B, a pair of rests 14A, 14B respectively affixed on the central base stand 11 near the two vertical guide stays 12A, 12B, and a rotatable axle 17 which is horizontally and rotatably passed through the central handle rest 13 of the center portion of the central base stand 11.

A pair of handle axles 171 each has a first end, in which the two first ends of the two handle axles 171 are pivotally connected to two outer ends of the rotatably axle 17 respectively. A pair of L-shape handles 172 are respectively extended upwardly from two second ends of the rotatably axle 17. By turning the two handles 172 about the two handle axles 171, the rotatable axle 17 can be turned thus be driven to freely rotate.

A driving element 15 which central portion is engaged by the rotatable axle 17 so that to rotate the rotatable axle 17 clockwise and counterclockwise can drive the driving element 15 to rotate about the rotatable axle 17 clockwise and counterclockwise simultaneously so as to drive two ends of the driving element 15 moving up and down.

A pair of draw bars 16A, 16B each has a pivot end. The two pivot ends of the two draw bars 16A, 16B are pivotally connected to the two ends of the driving element 15 respectively for enabling to pivotally and mutually drive one another.

A pair of adjustable links 18A, 18B are pivotally connected with two connecting ends of the two draw bars 16A, 16B respectively. Each of the adjustable links 18A, 18B has a predetermined number of evenly spaced adjustable holes 181 provided thereon Two bottom ends of the two adjustable links 18A, 18B are pivotally connected with the two rests 14A, 14B respectively.

A pair of toggle links 19 each has a first end pivotally connected to a top end of the corresponding adjustable link 18A, 18B.

A tubular supporting stand 20, which has a plurality of evenly spaced affixing holes 201 provided on both sides thereof, comprises a pair of hollow guiding tube 21A, 21B integrally and downwardly extended from a bottom portion of the supporting stand 20 for the two guide stays 12A, 12B to respectively insert therein.

A pair of bearers 22A, 22B are integrally and horizontally extended from the two guiding tubes 21A, 21B of the supporting stand 20 toward the two rests 14A, 14B respectively. The two bearers 22A, 22B each has a plurality of evenly spaced adjusting holes 22*a* provided thereon for enabling the two second ends of the two toggle links 19 selectively and pivotally connected with the two bearers 22A, 22B respectively.

A cushion 23, which has a soft surface for allowing a user to lay on top, is affixed on the tubular supporting stand 20 by engaging an affixing means 231 provided under the cushion 23 with the affixing holes 201 of the supporting stand 20. The plurality of affixing holes 201 allow the user to selectively adjust the cushion 23 to different positions on the supporting stand 20.

A seat cushion 24 is slidably mounted on the supporting stand 20 by a plurality of rollers provided under the seat cushion 24. The rollers allowed the seat cushion 24 to forwardly and backwardly slide forth and back along the supporting stand 20.

A pair of pedals 25 are pivotally connected to one of the guiding tubes 21B positioned near the seat cushion 24. The pedals 25 which are able to freely rotate as required are positioned at an adequate position for allowing the user to place his or her two feet thereon.

Figure 3:
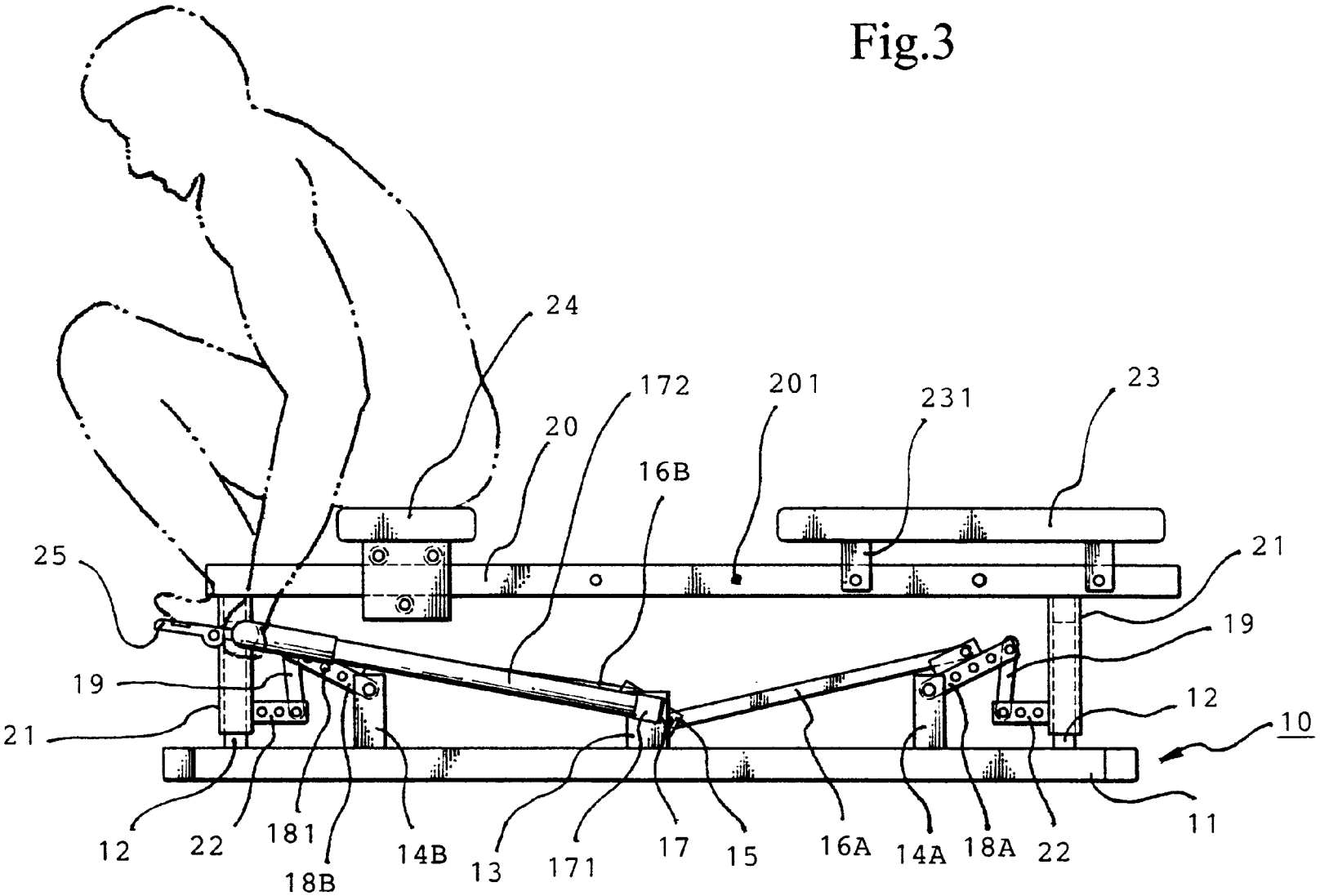
FIG. 3 is a side view of the body exerciser in accordance with the above preferred embodiment of the present invention, showing the boat rowing action exercise.

As shown in FIG. 3, the body exerciser according to the present invention enables the user to workout a boat rowing action exercise. The user can first place both feet comfortably positioning on the pedals 25 and sit on the seat cushion 24 and hold the two handles 172 near the pedals with both hands. Accordingly, the user can perform the boat rowing action exercise by pulling the handles 172 upwardly and outwardly by both hands (in clockwise direction as shown in FIG. 3) while having the feet and hip portion of the user as the supporting points by the feet pressing against the pedals 25 and the hip portion pressing against the seat cushion 24. As the user pulls up and down the handles 172 with hands, the legs of the user are fully stretched and the seat cushion 24 is also driven to slide backwardly so that the hands and different muscle groups of the body can all workout together to simulate the boat rowing action exercise.

Figure 4:
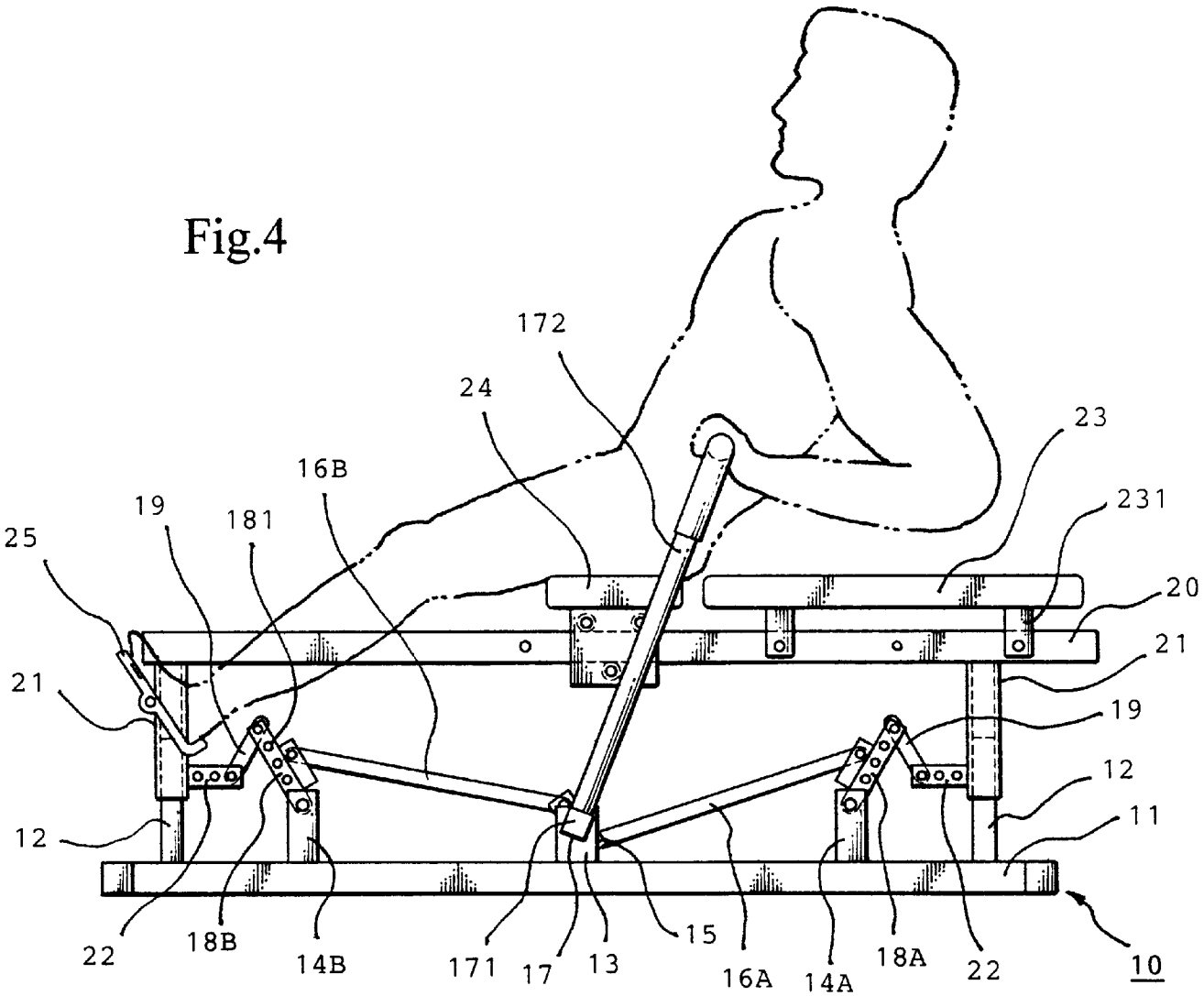
FIG. 4 is a side view of the body exerciser in accordance with the above preferred embodiment of the present invention, showing different exercising action of the FIG. 3.

Furthermore, while the handle axle 171 is rotated by the two uplifting handles 172, the driving element 15 is rotated clockwise simultaneously, as shown in FIG. 4, to pull the two draw bars 16A, 16B toward the central handle rest 13 and push up the two guiding tubes 21A, 21B by means of the pair of adjustable links 18A, 18B, the pair of toggle links 19 and the pair of bearers 22A, 22B, so that the cushion 23 or the seat cushion 24 of the supporting stand as well as the user thereon are propped upwardly by the two guiding tubes 21A, 21B. On the other hand, when the handle axle 171 is rotated by frontwardly and downwardly pushing the two handles 172, the driving element 15 is rotated counterclockwise simultaneously, as shown in FIG. 3, to push the two draw bars 16A, 16B away from the central handle rest 13 and lower the two guiding tubes 21A, 21B by means of the pair of adjustable links 18A, 18B, the pair of toggle links 19 and the pair of bearers 22A, 22B. Then the cushion 23 or the seat cushion 24 of the supporting stand as well as the user thereon are enables to drive downwardly by the two guiding tubes 21A, 21B. Therefore, by repeatedly pulling the handles 172 upwardly and backwardly and pushing the handles 172 downwardly and frontwardly, the cushion 23 or the seat cushion 24 as well as the user lay or sit thereon can be drive to move up and down through the in and out motion between the two guiding tubes 21A, 21B and the two guide stays 12A, 12B respectively.

Moreover, the user can adjust the moment of force of the handles 172 by adjusting the position of the toggle links 19 with respect to the adjusting holes 181 of the adjustable links 18A, 18B and the adjusting holes 221 of the bearers 22A, 22B, so that the tuning radius and the affixing angle between each of the toggles links 19 and each of the adjustable links 18A, 18b are change to different value in order to provide different moment of force range of the handles 172. The user can then workout according to his or her own strength or ability.

Figure 5:
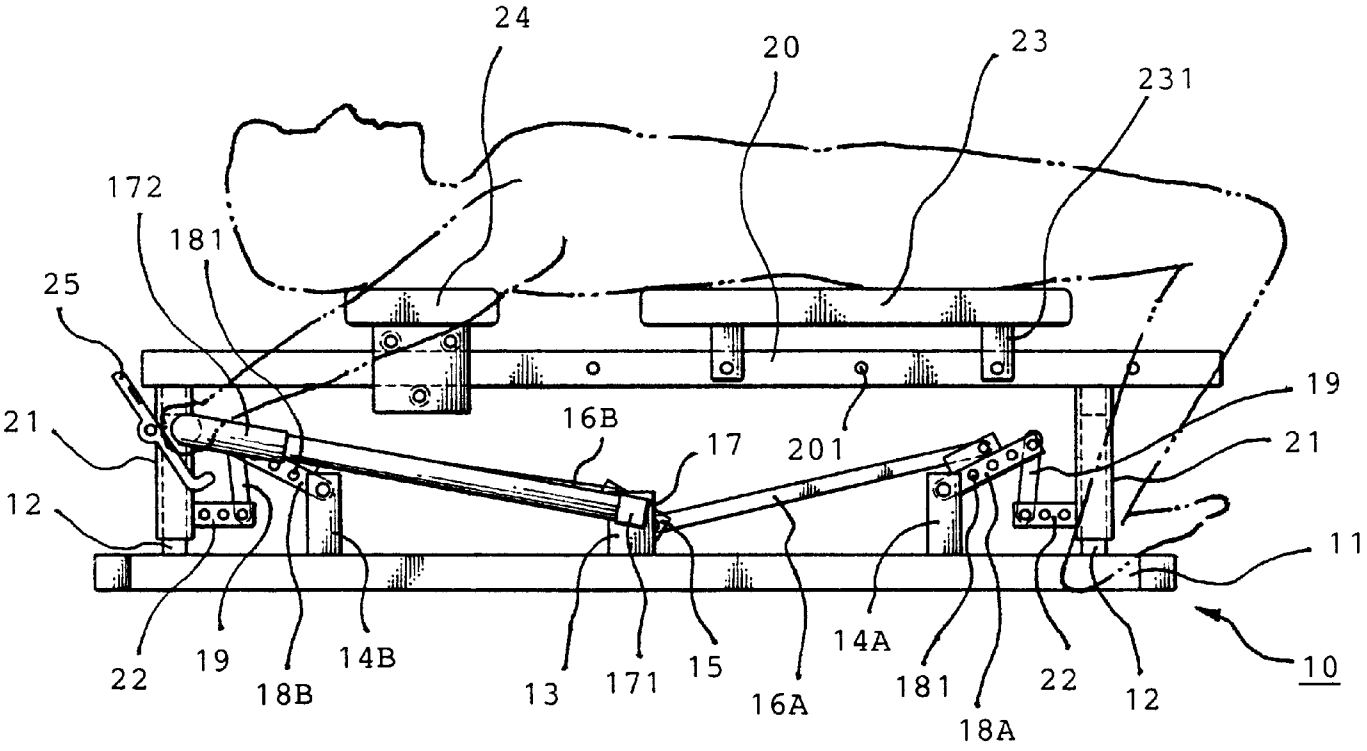
FIG. 5 is a side view of the body exerciser in accordance with the above preferred embodiment of the present invention, showing the bench pressing exercise.
Figure 6:
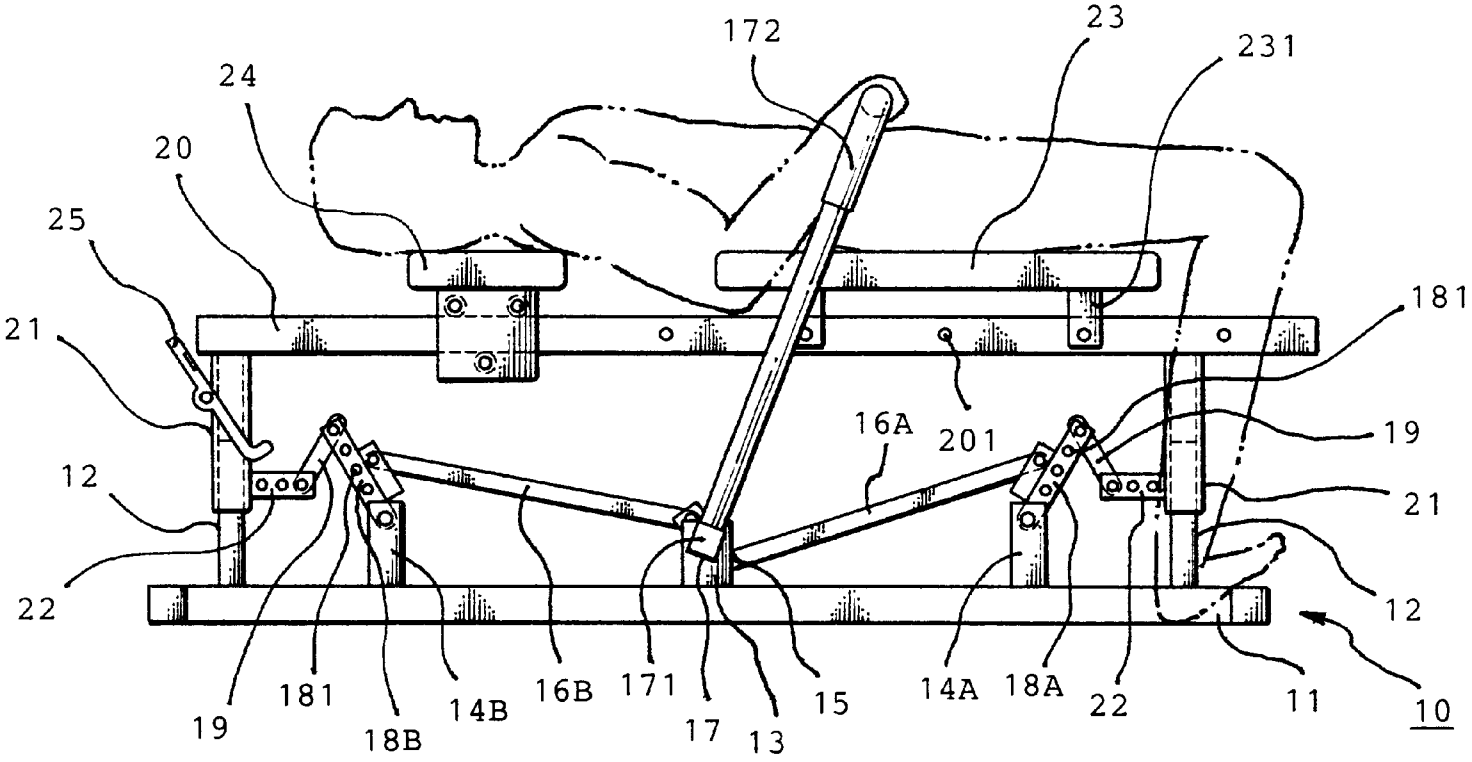
FIG. 6 is a side view of the body exerciser in accordance with the above preferred embodiment of the present invention, showing different exercising action of the FIG. 5.

As shown in FIGS. 5 and 6 of the drawings, the body exerciser as illustrated is operated to do bench pressing exercise, that starts with the handles 172 positioned near the pedals 25. The user lays on the cushion 23 with his or her head portion resting on the seat cushion 24. Both feet of the user can be positioned on the base frame 10. The user can perform the bench pressing exercising by pulling the handles 172 upwardly and outwardly with both hands (in clockwise direction as shown in FIG. 5) while having the feet, the hip portion and the back portion of the user as the supporting points. As the handles 172 are pushed upwardly and outwardly, the supporting stand 20 is lifted along with the whole weight of the user so as to simulate the bench pressing exercise.

Furthermore, the user can adjust the moment of force of the handles 172 by adjusting the positions of the two toggle links 19 with respect to the adjusting holes 181 of the adjustable links 18A, 18B and the adjusting holes 221 of the bearers 22A, 22B, so that the turning radius and the affixing angle between each toggle link 19 and each adjustable link 18A, 18B are change to different value to provide different moment of force range of the handles 172. The user can also workout according to his or her own strength or ability.

The body exerciser of the present invention in comparison with the conventional exercising machine has the following advantages:

(1) The present invention can allow the user to workout with his or her own body weight. The up and down motion of the present invention adds more fin during exercise.

(2) The well design of using the user's own body weight allows the user to have enough resistance and excellent workout result.

(3) The user can simply adjust the position of the toggle link to get into different level of workout, that allows any person with any strength to workout at their desire pace.

(4) The present invention takes advantage of the body weight of the user to replace the required weight set of the conventional bench pressing exercise. This makes the exercise not only safer, but also more economical because no money is waste to purchase the weight set.

(5) The present invention is small in size for the exercise that it can perform, therefore it is perfect for family use.

What is claimed is:

1. A body exerciser, comprising a H-shape base frame which has a central base stand, a pair of vertical guide stays upwardly and proximately extending from two ends of said central base stand, a U-shape central handle rest affixed at a center portion of said central base stand between said two vertical guide stays, a pair of rests respectively affixed on said central base stand near said two vertical guide stays, and a rotatable axle which is horizontally and rotatably passed through said central handle rest of a center portion of said central base stand;

a pair of handle axles each having a first end, in which said two first ends of said two handle axles are pivotally connected to two outer ends of said rotatably axle respectively;

a pair of L-shape handles being respectively extended upwardly from two second ends of said rotatably axle, by turning said two handles about said two handle axles, said handle axles being driven to freely rotate;

a driving element which has a central portion engaged by said rotatable axle, by rotating said rotatable axle clockwise and counterclockwise, said driving element being driven to rotate about said rotatable axle clockwise and counterclockwise simultaneously so as to drive two ends of said driving element moving up and down;

a pair of draw bars each having a pivot end, said two pivot ends of said two draw bars pivotally connecting to said two ends of said driving element respectively for enabling to pivotally and mutually drive one another;

a pair of adjustable links pivotally connected with two connecting ends of said two draw bars respectively, two bottom ends of said two adjustable links being pivotally connected with said two rests respectively;

a pair of toggle links each having a first end pivotally connected to a top end of said corresponding adjustable link;

a tubular supporting stand comprising a pair of hollow guiding tube integrally and downwardly extended from a bottom portion of said supporting stand for said two guide stays to respectively insert therein;

a pair of bearers integrally and horizontally extended from said two guiding tubes of said supporting stand toward said two rests respectively, wherein said two second ends of said two toggle links are pivotally connected with said two bearers respectively;

a cushion affixed on said tubular supporting stand;

a seat cushion slidably mounted on said supporting stand by a plurality of rollers provided under said seat cushion, said rollers allowing said seat cushion to forwardly and backwardly slide forth and back along said supporting stand; and a pair of pedals rotatably connected to one of said guiding tubes positioned near said seat cushion.

2. A body exerciser, as recited in claim 1, wherein each of said adjustable links has a predetermined number of evenly spaced adjustable holes provided thereon.

3. A body exerciser, as recited in claim 2, wherein said tubular supporting stand has a plurality of evenly spaced affixing holes provided on both sides thereof, said cushion being affixed on said tubular supporting stand by engaging an affixing means provided under said cushion with said affixing holes of said supporting stand, said plurality of affixing holes allowing the user to selectively adjust said cushion to different positions on said supporting stand.

4. A body exerciser, as recited in claim 2, wherein each of said two bearers has a plurality of evenly spaced adjusting holes provided thereon for enabling said two second ends of said two toggle links to selectively connected with said two bearers respectively.

5. A body exerciser, as recited in claim 3, wherein each of said two bearers has a plurality of evenly spaced adjusting holes provided thereon for enabling said two second ends of said two toggle links to selectively connected with said two bearers respectively.

* * * * *